United States Patent [19]

Shang

[11] Patent Number: 5,008,005

[45] Date of Patent: Apr. 16, 1991

[54] INTEGRATED COKE, ASPHALT AND JET FUEL PRODUCTION PROCESS AND APPARATUS

[75] Inventor: Jer Y. Shang, McLean, Va.

[73] Assignee: The United States of America as represented by the Department of Energy, Washington, D.C.

[21] Appl. No.: 422,479

[22] Filed: Oct. 17, 1989

[51] Int. Cl.[5] ..... C10G 1/00

[52] U.S. Cl. ..... 208/407; 208/409; 208/427; 208/432

[58] Field of Search ..... 208/407, 409, 427, 432

[56] References Cited

U.S. PATENT DOCUMENTS

| | | | |
|---|---|---|---|
| 4,466,360 | 8/1984 | Shang et al. | 110/264 |
| 4,578,175 | 3/1986 | Gorin | 208/408 |
| 4,725,350 | 2/1988 | Smith | 208/408 |
| 4,758,331 | 7/1988 | Kruse et al. | 208/408 |
| 4,842,719 | 6/1989 | MacArthur et al. | 208/408 |

*Primary Examiner*—Margaret B. Medley

*Attorney, Agent, or Firm*—David E. Breeden; Stephen D. Hamel; William R. Moser

[57] ABSTRACT

A process and apparatus for the production of coke, asphalt and jet fuel from a feed of fossil fuels containing volatile carbon compounds therein is disclosed. The process includes the steps of pyrolyzing the feed in an entrained bed pyrolyzing means, separating the volatile pyrolysis products from the solid pyrolysis products removing at least one coke from the solid pyrolysis products, fractionating the volatile pyrolysis products to produce an overhead stream and a bottom stream which is useful as asphalt for road pavement, condensing the overhead stream to produce a condensed liquid fraction and a noncondensable, gaseous fraction, and removing water from the condensed liquid fraction to produce a jet fuel-containing product. The disclosed apparatus is useful for practicing the foregoing process. the process provides a useful method of mass producing and jet fuels from materials such as coal, oil shale and tar sands.

8 Claims, 1 Drawing Sheet

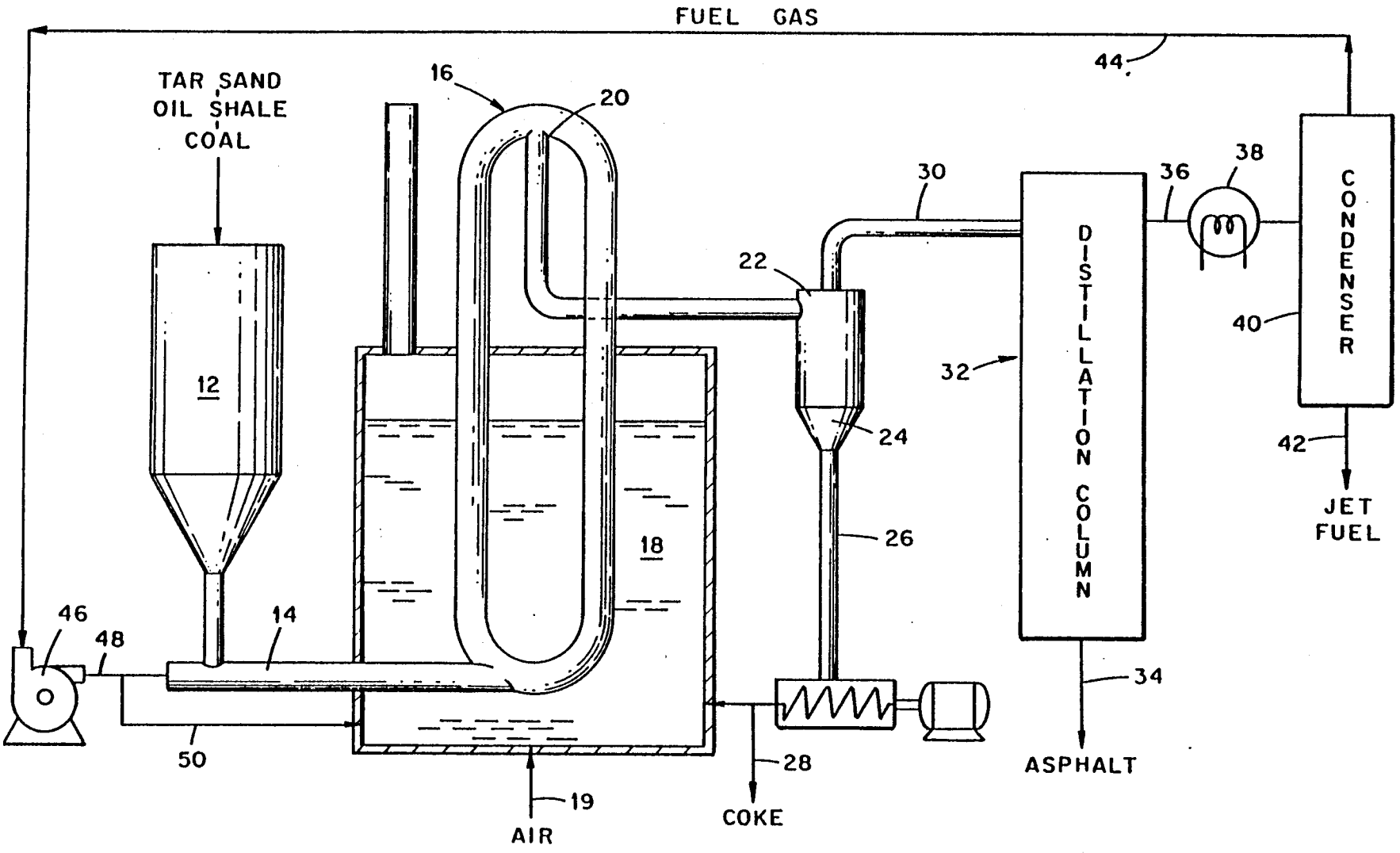
CONDENSER
JET FUEL
42
40
38
36
44
DISTILLATION COLUMN
34
ASPHALT
32
30
24
26
22
28
COKE
FUEL GAS
18
20
19
AIR
16
14
TAR SAND
OIL SHALE
COAL
12
50
48
46

INTEGRATED COKE, ASPHALT AND JET FUEL PRODUCTION PROCESS AND APPARATUS

BACKGROUND OF THE INVENTION

The present invention relates to a process and apparatus for producing coke, asphalt and jet fuel from fossil fuels containing volatile carbon compounds therein. More particularly, the present process employs an entrained bed pyrolyzer for the purpose of producing coke, asphalt and jet fuel from materials such as tar sands, oil shale, coal or mixtures thereof.

Wide utilization of coal, oil shale and tar sands depends on the integrated mass production of products. The fluidized-bed reactor is generally considered to be the ideal solid processing reactor because of its high solid throughput of about 3,000 lbs./hr./sq.ft. bed area, especially when compared to the 400 lbs./hr./sq.ft. of bed area throughput for such reactors as the moving bed reactor.

However, past experience has shown that fluidized-bed reactors may not be an ideal reactor for handling coal, oil shale or tar sands because of the tendency of the e e materials to cake. Fluidized-bed reactors are unable to handle caking materials, and attempts to burn caking materials in a fluidized-bed reactor without inert matter resulted in the clinkering of the entire fluidized-bed. Many operational failures occurred in early coal pyrolysis products and these were also attributed to the caking problem.

Generally, there are two typical coals which are used for the United States Coal Standards, the Illinois No. 6 seam coal and the Pittsburgh No. 8 seam coal. The Illinois No. 6 coal has a free swelling index of 3 to 4, a high sulfur content (3% or more) and a high chlorine content (0.39%). The Pittsburgh No. 8 seam coal has a free swelling index of 8, a high sulfur content (3% or more) and a somewhat lower chlorine content of about 0.06%. Chlorine is a very corrosive element at high combustion temperature, and thus, Illinois No. 6 coal is best suited for liquid production, which is accomplished at lower combustion temperatures. It is the general consensus that fluidized-bed and moving-bed reactors are not adequate to handle caking coals such as the Illinois No. 6 seam coal and the Pittsburgh No. 8 seam coal.

Thus, there is a need in the art for a coal combustion reactor which is capable of handling coals, oil shales and tar sands which have a tendency to cake under typical combustion conditions in fluidized-bed reactors. There is also a need in the art for a reactor for utilizing coal, oil shale and tar sands which has a high throughput rate and thus allows mass production of desirable products from these materials.

SUMMARY OF THE INVENTION

The present invention relates to a process for the production of coke, asphalt and jet fuel from a feed of fossil fuels having volatile carbon-containing compounds therein, the first step in the process involves pyrolyzing the feed in an entrained bed pyrolyzing means and separating the volatile pyrolysis products from the solid pyrolysis products. Then, at least some coke is removed as product from the solid pyrolysis product. The volatile pyrolysis products are subsequently fractionated in a distillation column to produce an overhead stream and a bottom stream which is useful as asphalt for road pavement. The overhead stream from the distillation column is condensed to product a condensed liquid fraction and a noncondensable gaseous fraction. Water is removed from the condensed liquid fraction to leave a jet fuel-containing product.

In a second aspect, the present invention relates to an apparatus for the production of fossil fuels having volatile carbon compounds therein. The apparatus includes at least one entrained bed pyrolyzer and a means for heating the at least one entrained bed pyrolyzer to pyrolysis temperatures. The apparatus also includes a separating means for separating solid pyrolysis products containing coke from volatile pyrolysis products. Further, the apparatus includes a distillation means for distilling the volatile pyrolysis products to produce a bottom fraction useful in asphalt and an overhead fraction. It is noted that the distillation column further serves as a scrubber which removes the dust particles that accompany the pyrolyzed products. Finally, the apparatus includes a condensing means for condensing the overhead fraction to a condensed liquid and a means for removing water from the condensed liquid to produce a jet fuel-containing product.

It is the primary object of the present invention to provide a process for the production of coke, asphalt and jet fuel from a feed of fossil fuels having volatile carbon compounds therein and most desirably coal, oil shale or tar sands which is suitable for mass production purposes and, thus, economically feasible.

It is a still further object of the present invention to provide a process for producing useful products from coal, oil shale or tar sands which overcomes the problem of caking of these materials in a fluidized-bed reactor environment.

It is a still further object of the present invention to provide an apparatus for utilizing coal, oil shale and tar sands to mass produce useful products, these, and other objects of the present invention, will be apparent to one of ordinary skill in the art from the detailed description which follows:

BRIEF DESCRIPTION OF THE DRAWING

The single figure is a process flow diagram for an integrated process for producing coke, asphalt and jet fuel from fossil fuels having volatile carbon compounds therein.

DETAILED DESCRIPTION OF THE PREFERRED EMBODIMENTS

Referring now to the single figure, there is shown a flow diagram for the process of the present invention for producing coke, asphalt and jet fuel products from fossil fuels containing volatile hydrous carbon compounds. In the process, fossil fuels such as tar sands, oil shale or coal are fed in solid form to hopper 12 and are mixed with a carrier material in feed pipe 14. The fossil fuels are then fed from feed pipe 14 into loop-bed pyrolyzer 16 which is partially immersed in fluidized bed heater 18. A bed-fluidizing and combustion supporting stream of air is introduced into the base of the fluidized bed heater 18 through feed pipe 19. Fluidized-bed heater 18 generates sufficient heat to cause pyrolysis of the solid feed materials in loop-bed pyrolyzer 16. Inside loop bed pyrolyzer 16, the solid particles are subjected to a high degree of inter-particle attrition and thermal spalling to yield numerous small particles. At the top of the loop, the centrifugal force acts on the entrained solid particles to move them to the top or far side of the loop. Vapors and fine particles exit loop bed pyrolyzer 16 from underside port 20 located in the top portion of loop-bed pyrolyzer 16. From underside port 20, vapors and fine particles are fed to a cyclone separator 22, which may be any suitable, known commercial cyclone separator. Cyclone separator 22 retains solid pyrolyzing products including spent sorbents, chars and coke particles in the bottom 24 of cyclone separator 22. A portion of these solids materials are fed back to fluidized bed heater 18 via the display or solid recycle line 26, where thy are combusted to product the heat of pyrolysis for loop-bed pyrolyzer 16. Optionally, solid products such as coke can be removed for other purposes through solid product line 28 rather than recycling them to fluidized bed heater 18 for combustion.

At the top of cyclone separator 22, the volatiles, mostly hydrocarbons, water and fuel gases which may have entrained fine solid matter therein, are fed through volatile feed line 30 to distillation column 32 for further separation. Distillation column 32 may be any suitable, commercial available distillation column. Bottom stream 34 from distillation column 32 is generally high in nitrogen, sulfur and solid content. Thus, bottom stream 34 is ideal for use as asphalt in road paving, particularly since fine solid particles are excellent fillers for road pavement. Overhead stream 36 from distillation column 32 is fed to heat exchanger 38 and then to condenser 40 to produce a condensed liquid stream 42, a major portion of which can be used for jet fuel feeding stock, the other product of condenser 40 is a noncondensable fuel gas stream 44 which is preferably pressurized by a pressurizing apparatus such as blower 46 and fed tack to feed pipe 14 through carrier line 48 to act as a carrier material for solid feed materials fed into hopper 12.

In another embodiment, a portion of non-condensable fuel gas stream 44 may also be diverted to fluidized bed heater 18 via fuel recycle line 50 in order to provide additional combustible materials for generating the heat of pyrolysis necessary for loop-bed pyrolyzer 16.

Loop-bed pyrolyzer 16 is the preferred embodiment of an entrained bed reactor for use in the present invention. However other suitable entrained bed reactors known to those of ordinary skill in the art may also be employed in the process of the present invention as long as they are capable of handling feed materials which are prone to caking in the reactor vessel. A suitable loop-bed combustion apparatus is disclosed in U.S. Pat. No. 4,466,360 issued on Aug. 21, 1984, the disclosure of which is hereby incorporated by reference.

In the process of the present invention, fossil fuels, which include volatile hydrocarbon-containing compounds therein, such as coal, oil shale, tar sand and/or sulfur sorbents are fed into the entrained bed reactor through an eductor by a carrier material which comprises recycled fuel gas. The heat of pyrolysis is supplied by a fluidized-bed heater 18. In fluidized-bed heater 18, which may be any conventional, known fluidized-bed heater, combustion of fuel gas and/or chars from the solid products of pyrolysis such as coke, is employed to produce heat.

The intense mixing and heating which occurs inside the entrained bed reactor generates a large amount of volatile compounds. The volatile pyrolysis products are then separated form the other materials by both the centrifugal forces inside the entrained bed reactor as well as the subsequent cyclone separator. The cyclone-retained solid pyrolysis products contain spent sorbents and chars/coke particles which can be used as fuels for power generation and/or to supply the heat of pyrolysis. The sorbent is most likely in the form of calcium sulfide or calcium sulfite and therefore further combustion is generally desirable to form the more stabile calcium sulfate which is much easier to dispose of.

The volatiles, mostly hydrocarbons, water, fuel gases and some entrained fine solid particle matters are fed from the cyclone separator to a distillation column for solid separation and product fractionation. It is conceived that the distillation column can function as both a dust scrubber for solid particle retention and a hydrocarbon separation unit. In fact, Lurgi-Ruhur has used a similar distillation column to recover dust-laden oil shale retort products.

The overhead stream from the distillation column is then condensed in any suitable condensing apparatus known in the art. The condensed overhead stream contains a condensed liquid fraction and a noncondensable gaseous fraction.

The condensed overhead stream from the distillation column is subsequently decanted to remove condensed water, condensed refluxing or scrubbing liquids and the noncondensable gases are separated therefrom. Part of the hydrocarbon liquid is returned to the distillation column as a reflux stream and also functions as a scrubbing liquid. A major portion of the overhead condensed liquid can be used for jet fuel feedstock.

The noncondensable fuel gas is compressed and reused as a carrier gas for feeding the solid feed materials into the entrained bed pyrolyzer. It is also possible to steam reform this hydrogen-rich noncondensable fuel gas to produce cheap hydrogen which can be used for fuel upgrading.

The bottom stream from the distillation column is typically high in nitrogen, sulfur and solid content. For example, solid contents can be as high as 40% and most of the nitrogen and sulfur from the process remain with this heavy fraction. Sulfur has no detrimental effects on the bottom stream for the purposes of road pavement and, thus, the bottom stream is ideal for incorporation into asphalt for road paving, particularly since the fine solids particles therein make excellent fillers for road paving. In particular, some of the nitrogen compounds are excellent additives for road pavement.

The solid throughput in the entrained bed reactor is on the order of 10 tons/hr./sq. ft. of bed area. For a low velocity design, a solid flux of 3 tons/hr./sq. ft. also appears reasonable. However, the throughput rate and modes of reaction will differ slightly depending upon the particular feed material which is employed for the process. Coal devolatilization, depending upon the type of coal, typically takes only a few seconds in the entrained bed pyrolyzer.

In the optimum process, the loop-bed pyrolyzer should have its bottom loop extended to the outside of the fluidized bed. Auxilliary gas jets can be located in strategic positions to enhance the turbulence in the loop-bed pyrolyzer and thereby avoid unwanted agglomeration. It is also possible to employ several entrained bed pyrolyzers in a single apparatus to greatly increase the quantity of pyrolysis which can be accomplished in a given time period. In this situation, a common header should be employed for all of the top loops of the entrained bed pyrolysis apparatus to facilitate maintenance work.

Further downstream, the cyclone separator should be insulated or maintained at a sufficient temperature to avoid premature condensation of oil and tars before they enter the distillation column.

The loop-bed pyrolyzer disclosed in U.S. Pat. No. 4,466,360 may be employed in the present process. However, multi-loop-bed pyrolyzers may also he employed. If such a multi-loop configuration is employed, gas/vapor off takes should be provided at the top of each loop to avoid secondary cracking of pyrolysis products in the pyrolyzer.

The process of the present invention provides significant advantages over prior art processes since none of the products are discarded and many are recycled into the process. In addition, the coal char fines which are formed from the present process are extremely fine. Thus, a substantial savings in coal size-reducing and coal slurry production may also be an added advantage. Accordingly, the feed materials used in the process of the invention to not require significant reduction in size prior to being fed to the process.

The bottom stream from the distillation column is an excellent material for producing asphalt for road paving. Thus, the present process can be employed as an alternative method for producing asphalt from materials such as coal, tar sands and oil shale.

Finally, jet fuel feedstock can be produced by the present process in large quantities from materials such as coal, oil shale and tar sands. Thus, this process also provides an alternative means for making jet fuel.

The foregoing description of embodiments of the invention has teen provided for the purposes of illustration and description only. Many modifications and variations will be apparent to one of ordinary skill in the art from the above description. Accordingly, the scope of the present invention is to be defined by the claims appended hereto.

What is claimed is:

1. A process for the production of coke, asphalt and jet fuel from a feed of fossil fuels containing volatile carbon compounds therein comprising the steps of:

pyrolyzing the feed in an entrained bed pyrolyzing means; separating the volatile pyrolysis products from the solid pyrolysis products;

removing at least some coke as a result from the solid pyrolysis products;

fractionating the volatile pyrolysis products to produce an overhead stream and a bottom stream which is useful as asphalt for road pavement;

condensing the overhead stream to produce a condensed liquid fraction and a noncondensable, gaseous fraction; and removing water from the condensed liquid fraction to produce a jet fuel-containing product.

2. A process as claimed in claim 1 wherein said entrained bed pyrolyzing means comprises at least one loop-bed combustion apparatus.

3. A process as claimed in claim 2 wherein said entrained bed pyrolyzing means comprises at least two loop-bed combustion apparatus.

4. A process as claimed in claim 2 further comprising the step of:

recycling at least one of the noncondensable, gaseous fraction from said condensing step to the entrained bed pyrolyzing means as a carrier gas for feeding solids into the entrained bed pyrolyzer.

5. A process as claimed in claim 4 further comprising the step of:

heating the entrained bed pyrolyzing means by combusting a portion of the solid pyrolysis products from said separation step.

6. A process as claimed in claim 5 wherein said heating step is carried out in a fluidized-bed heater.

7. A process as claimed in claim 5 wherein said step of recycling at least some of the noncondensable, gaseous fraction further comprises recycling some of the noncondensable, gaseous fraction to said heating step to aid in combusting the solid pyrolysis products.

8. A process as claimed in claim 2 further comprising the step of steam reforming the noncondensable, gaseous fraction from said condensing step to produce a hydrogen-containing product.

* * * * *